United States Patent [19]

Richards et al.

[11] 3,990,353

[45] Nov. 9, 1976

[54] APPARATUS FOR PRODUCING A CONTAINER

[75] Inventors: Frank P. Richards; Raymond C. Taylor, both of Kansas City, Mo.

[73] Assignee: Phillips Petroleum Company, Bartlesville, Okla.

[22] Filed: Apr. 21, 1975

[21] Appl. No.: 569,731

[52] U.S. Cl. ..... 93/1.3; 93/36 B; 93/39.3

[51] Int. Cl.[2] ..... B31B 17/02; B31B 17/26

[58] Field of Search ..... 93/1.3, 36 B, 1 D, 39.1 R, 93/39.3

[56] References Cited

UNITED STATES PATENTS

| | | | |
|---|---|---|---|
| 25,302 | 12/1962 | Allen | 93/39.1 |
| 2,105,582 | 1/1938 | Butler | 93/39.3 |
| 2,546,621 | 3/1951 | Wixon et al. | 93/39.3 |
| 2,642,784 | 6/1953 | Wittkuhns et al. | 93/39.3 |
| 2,832,522 | 4/1958 | Schlanger | 93/1.3 X |
| 3,157,339 | 11/1964 | Negoro | 229/5.5 |
| 3,739,695 | 6/1973 | Peacock | 93/39.1 R |

*Primary Examiner*—Travis S. McGehee

[57] ABSTRACT

A container having a sidewall secured to a bottom member which has a bottom panel with a plurality of spaced apart fold lines between same and a depending skirt. The apparatus includes an arrangement for forming the bottom member from a blank with the apparatus including a forming die through which the blank is passed by use of a plunger arrangement with the die having a plurality of different size forming areas which cooperate with the plunger arrangement to form the fold lines and skirt. Means feed the blanks to the die and plunger arrangement for forming after which the bottom member is secured to the sidewall to form a container.

8 Claims, 9 Drawing Figures

APPARATUS FOR PRODUCING A CONTAINER

One of the problems associated with the manufacture of containers is inserting the formed bottom member into the sidewall formed about a mandrel for securing the bottom member to the sidewall. In the past the common practice was to try and insert the formed bottom member through the end which it is secured adjacent to. This is a particularly difficult problem in certain types of containers such as those having a tapered sidewall with the bottom end having a smaller diameter than the open end. This problem becomes increasingly difficult as the degree of taper of the sidewall increases. One method of manufacturing of such a container is to form a bottom member having a sufficiently smaller size than the entrance of the bottom end of the container whereby same could be inserted through the entrance and later secured to the sidewall. Such a method prevented intimate contact of the skirt portion of the bottom member with the sidewall with the attendant difficulties in securing the skirt to the sidewall. Another method used is to wrap a sidewall on a mandrel and around a bottom member held on the end of the mandrel. The skirt of a properly sized bottom member generally presented too much resistance to the sidewall and thereby prevented a good consistent wrap around the mandrel. The present invention overcomes the above difficulties and allows the formation of a container having consistently formed sidewalls and good engagement between same and the skirt portion of the bottom member to facilitate securing of same together.

The principal objects and advantages of the present invention are: to provide an apparatus and method to form a container having a bottom member with a plurality of fold lines to facilitate container assembly; to provide such an apparatus which utilizes a die and plunger arrangement to form a blank into a bottom member having a bottom panel portion with a plurality of spaced apart fold lines between same and a depending skirt portion with the smaller fold line being sized for easy insertion of the bottom member into a mandrel and the larger fold line being sized for firm engagement of the skirt with a container sidewall to facilitate securing of same together; to provide such an apparatus which is automatic in operation for feeding and forming blanks into bottom members; to provide such an apparatus which is simple in construction and operation and well adapted for its intended use; and to provide such an apparatus and method which is adapted to manufacture conventional type containers having tapered or untapered sidewalls.

Other objects and advantages of the present invention will become apparent from the following detailed description taken in connection with the accompanying drawings wherein are set forth by way of illustration and example certain embodiments of the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriate detailed structure.

Figure 1:
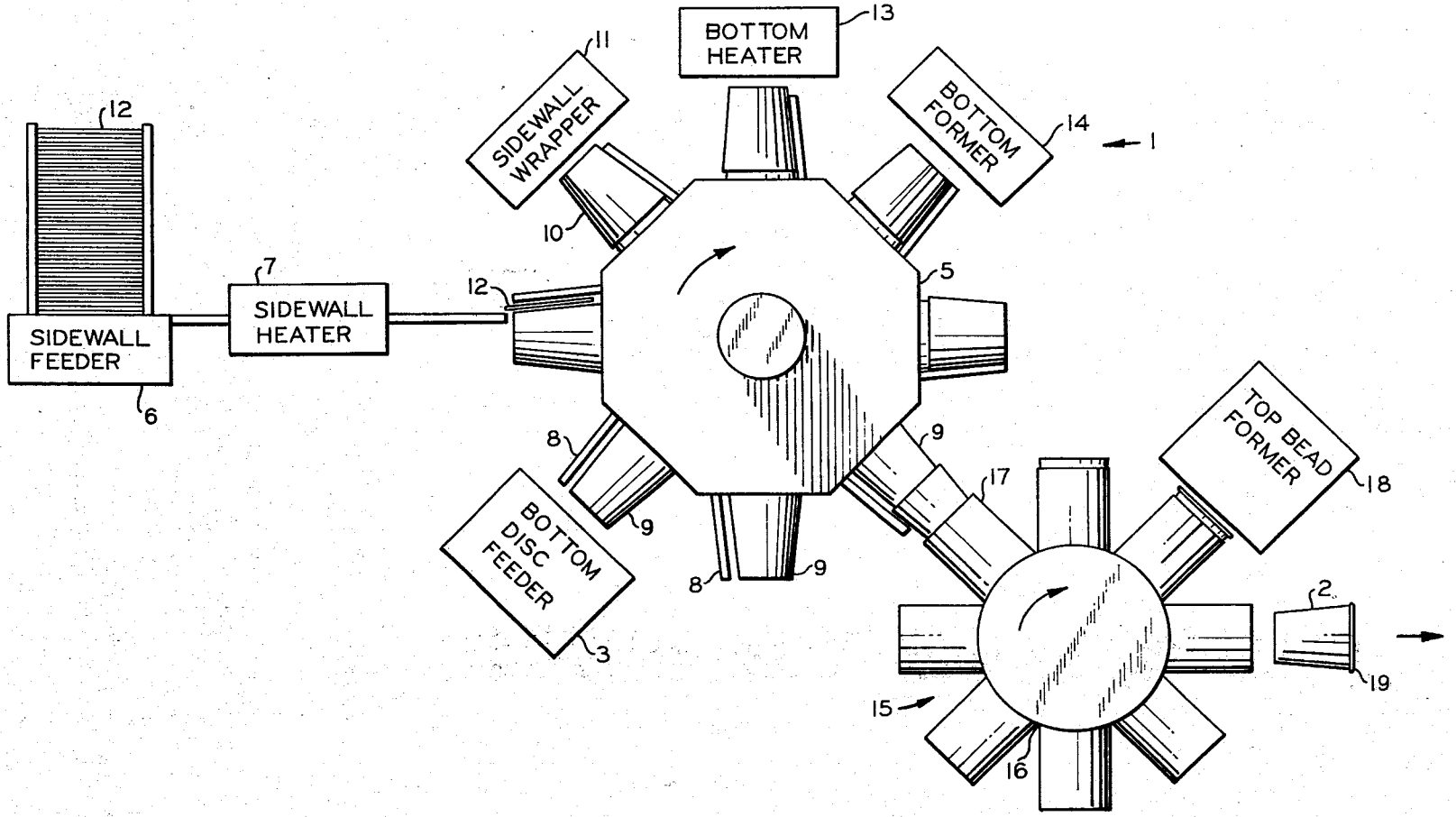
FIG. 1 is a side elevational diagrammatic illustration of a container-forming apparatus.
Figure 2:
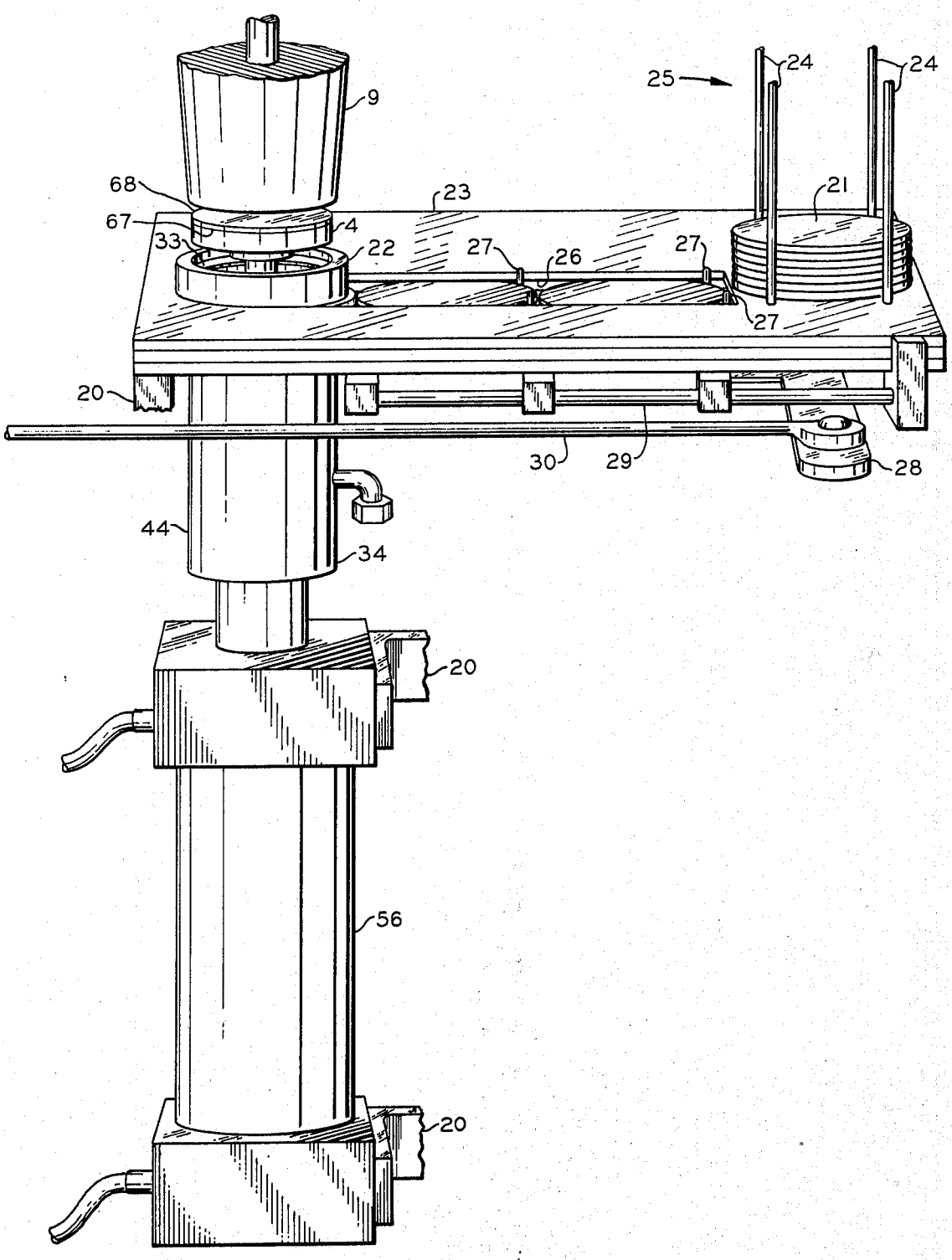
FIG. 2 is an enlarged fragmentary view of a portion of the container-forming apparatus showing means for forming bottom members.
Figure 9:
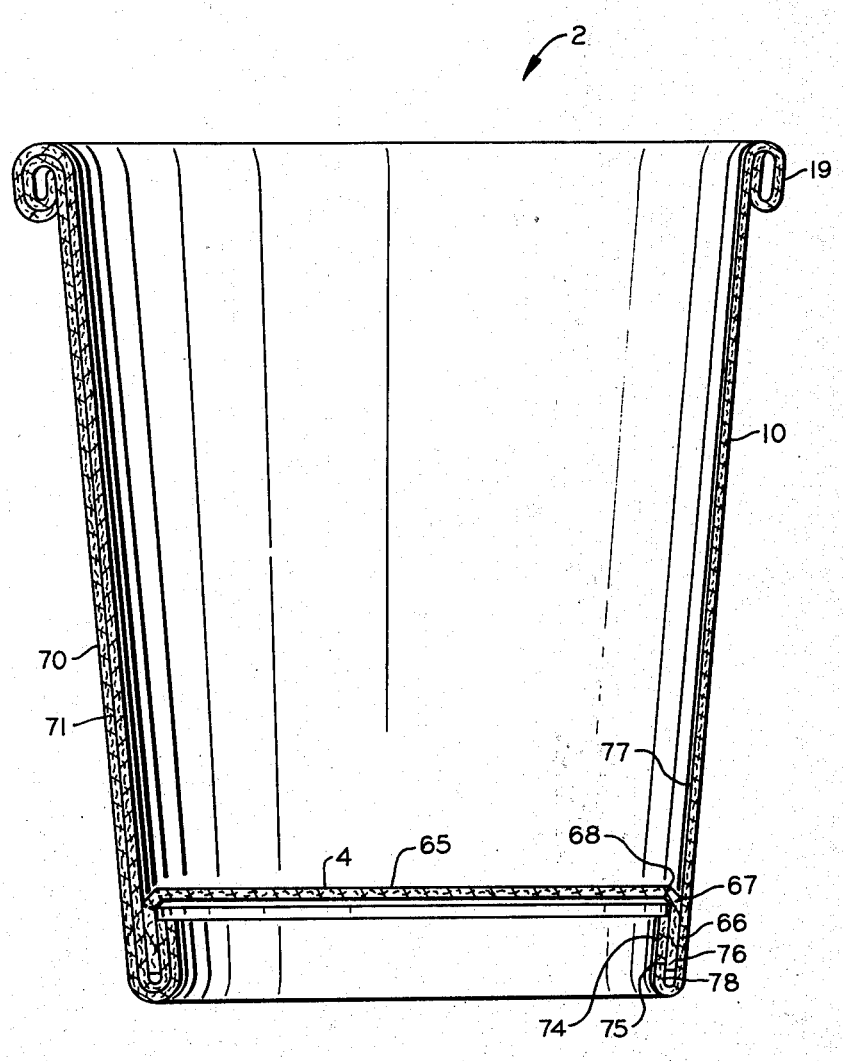
FIG. 9 is an enlarged sectional view of a container formed by the container-forming apparatus.

Referring more in detail to the drawings:

Referring to FIGS. 1 and 9, the reference numeral 1 designates generally an apparatus for the forming or manufacture of containers such as the container 2. The apparatus 1 includes a bottom blank or disc feeder 3 which is operable to form bottom members 4 for the container 2. The feeder 3 feeds and positions bottom blanks prior to subsequent forming operations by other portions of the apparatus 1, which includes a multiple head turret arrangement 5, which has means well known in the art to form containers. As shown, the means includes a sidewall feeder 6 from which sidewalls blanks are fed to a sidewall heater 7 which are then fed to one of the heads on the turret 5. A clamp member 8 holds the sidewall on one of the heads or mandrels 9 for subsequent forming. A sidewall wrapper 11 is operable to wrap or convolute the sidewall blank 12 around the mandrel to form a sidewall 10. Indexing of the turret 5 then moves the mandrel 9 having the wrapped sidewall thereon to a bottom heater 13 which is operable to heat the bottom member 4 and portions of the sidewall 12 after which the mandrel is indexed to a bottom former 14. The bottom former 14 suitably secures the bottom member 4 to the formed sidewall 10. Further indexing of the turret 5 moves the mandrel having a partially formed container 2 thereon to means 15 into which the formed containers are ejected for further processing. The means 15 shown includes an indexable turret 16 which has a plurality of container receiving members 17 and upon subsequent indexing, the containers are moved to a top bead forming device 18 which is operable to form a bead 19 on one end of the container 2. Further indexing of the turret 16 moves the members 17 containing a completed container to a position for ejection from the apparatus 1.

The bottom member former 3 is best seen in FIGS. 2, 3, 5, 6, 7 and 8. As shown, bottom blanks 21 are fed to a forming die 22 by suitable means. In the illustrated structure the means include a support member 23 which has a storage magazine 25 formed by a plurality of upstanding members 24 and adapted to store a plurality of bottom blanks 21. Tracks 26 are provided along which bottom blanks 21 are moved from the magazine 25 to the die 22 such as by engagement with fingers 27. The fingers 27 are mounted on a carriage 28 which is slidably mounted on bearing rods or ways 29 with the carriage 28 being movable in response to actuation of a link 30 which is moved by power means (not shown) such as a pneumatic cylinder or other means such as a lever arm operable by the main drive shaft of the machine. The illustrated structure for feeding the bottom blanks and the extendable ram 56 are suitably supported on the frame (not shown) of the apparatus 1 such as by members 20. Movement of the carriage 28 in one direction indexes a bottom blank 21 into a position between the die 22 and plunger arrangement 34 as later described. Movement of the carriage in the opposite direction effects retraction of the fingers 27 so as to be out of engagement with a respective bottom blank and upon return of the carriage 28 the fingers 27 are extended by means (not shown) for engagement once again with a bottom blank 21.

Preferably, the die 22 is mounted on the support 23 and has open ends 32 and 33 whereby a bottom blank 21 is moved into position adjacent the open end 32 by movement of the carriage 28. The die 22 has a plurality of different size forming areas as does a plunger arrangement 34 whereby the die 22 and plunger 34 cooperate to form a bottom member 4 from a bottom blank 21. As shown, the die 22 has a through bore 35 with the plurality of forming areas, in the illustrated structure, being two in number and are denoted by the reference numerals 37 and 38. It is to be noted, however, that any number, two or more, of different sized areas can be provided in the die 22. Preferably, the bore 35 is traversely circular whereby the forming areas 37 and 38 have different diameters with the area 37 being larger in diameter than the area 38. Radiused corners 39 and 40 are provided for each of the areas 37 and 38, respectively, to provide a smooth lead-in for each of the areas. Preferably, a recess or annular groove 41 is positioned between the area 37 and area 38 and has a diameter larger than either of the areas. The groove 41 provides clearance for portions of the bottom member 4 to facilitate the forming operation as later described. A circumferential flange 42 is provided on the exterior of the die 22 to facilitate mounting of same on the support 23.

The plunger arrangement 34 in the illustrated structure includes a plurality of relatively movable portions having different sizes to cooperate with the different sized forming areas 37 and 38. As shown, the plunger arrangement includes a first plunger 44 and a second plunger 45. Preferably, the second plunger 45 is carried by the plunger 44 and has means cooperating therewith to move same independently of the plunger 44. As shown, the plunger 44 is provided with a cylinder-forming bore 46 which has a plunger receiving pocket 47 adjacent the open end thereof. The plunger 45 is sized to be received in the pocket 47 for its retracted position and has a rod 48 extending through a bore through a bearing block 49 and has a piston-forming end 50 received within the bore 46 forming a pneumatic extendable ram. A spring 51 is positioned between the bearing block 49 and the piston end 50 to effect return of the piston 45 to its retracted position in the pocket 47. An air passage 52 communicates with the bore 46 and is operable to supply pressurized air thereto for extension or movement of the piston 45 from the pocket 47 as described below. Extension or movement of the plunger 45 is limited by a stop 53, secured to the piston end 50, when it engages the bearing block 49 which is retained against movement by a keeper 55.

Figure 3:
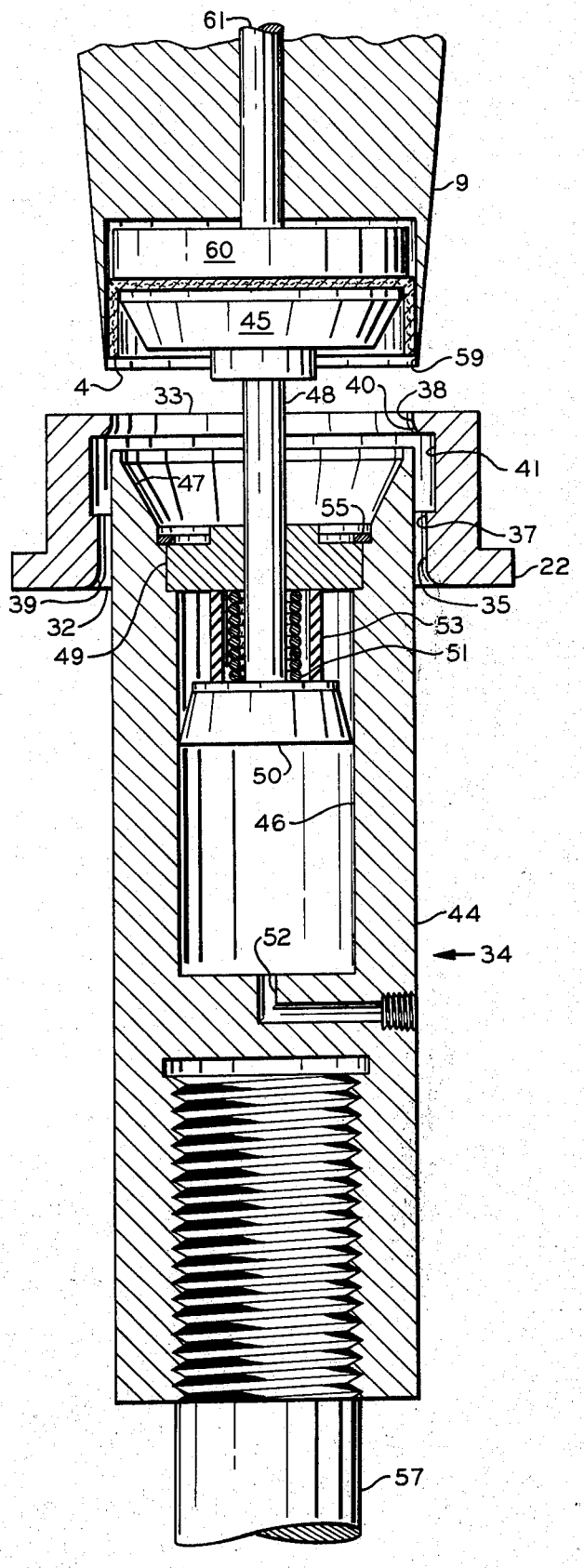
FIG. 3 is an enlarged fragmentary sectional view of means for forming bottom members.

The plunger arrangement 34 has means cooperating therewith to effect movement of same into and out of the die 22. As shown, the plunger arrangement 34 is mounted on an extendable ram 56 as by threaded engagement with a piston rod 57. In the illustrated structure, extension of the ram 56, which preferably is a pneumatic ram, effects movement of the plunger arrangement 34 into the die 22 with the movement of the plunger 44 being limited so that movement will terminate just prior to entering the forming area 38. Pressurized air is supplied to the cylinder-forming bore 46 to then extend the plunger 45 through the forming area 38 into a bottom member receiving pocket 59 in a mandrel 9. As best seen in FIGS. 1 and 3, the pocket 59 opens or faces generally toward the plunger arrangement 44 and die 22 when the mandrel 9 is adjacent the feeder 3. As shown, the mandrel 9 has an ejector 60 movably mounted in the pocket 59 with an actuator rod 61 extending through a bore in the mandrel 9 for selective movement of the ejector by means (not shown). Preferably, the ejector 60 has a diameter less than the diameter of the pocket 59 for a purpose to be later described.

Figure 5:
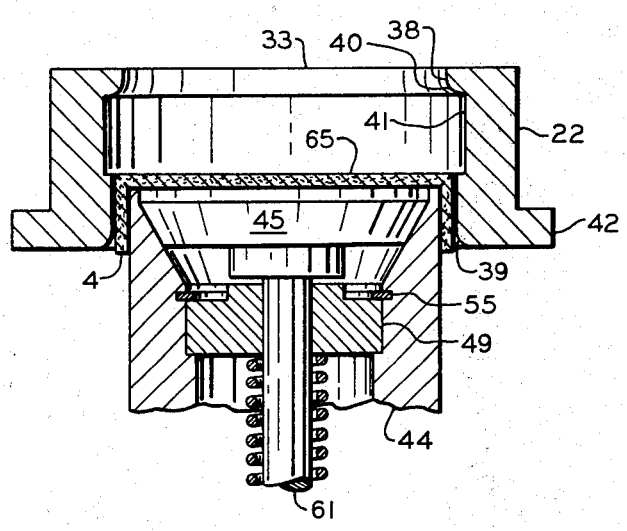
FIG. 5 is an enlarged fragmentary sectional view of a die and plunger arrangement used to form a bottom member from a blank showing the bottom member in one stage of formation.
Figure 6:
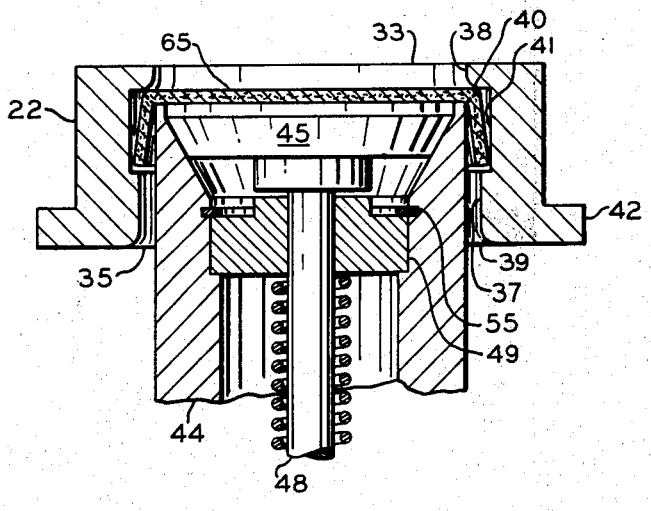
FIG. 6 is a view similar to FIG. 5 showing a second stage of formation of the bottom member.

The present invention is more fully understood by a description of the operation thereof. At the start of operation of the apparatus 1, with plunger arrangement 34 spaced from the forming area 37 and the plunger 45 retracted into pocket 47, a bottom blank 21 is fed between die 22 and plunger arrangement 34 adjacent the open end 32. The ram 56 is then actuated to extend or move the plunger arrangement 34 to a position whereby the plunger 44 is in engagement with the bottom blank 21. As best seen in FIG. 5, the plunger 44 forces the bottom blank 21 into the forming area 37, forming the bottom blank 21 into bottom member 4 with a bottom panel 65 and a depending skirt 66 and a first fold or score line 67 therebetween. As best seen in FIG. 6, further movement of the plunger 44 moves the bottom member 4 to a position where the skirt 66 is received within the groove 41 to substantially eliminate frictional engagement between portions of the die 22 and plunger 44 and the skirt 66 to facilitate further movement of the bottom member 4. Movement of the plunger 44 is limited or terminated such as by limiting the stroke of the ram 56.

Figure 4:
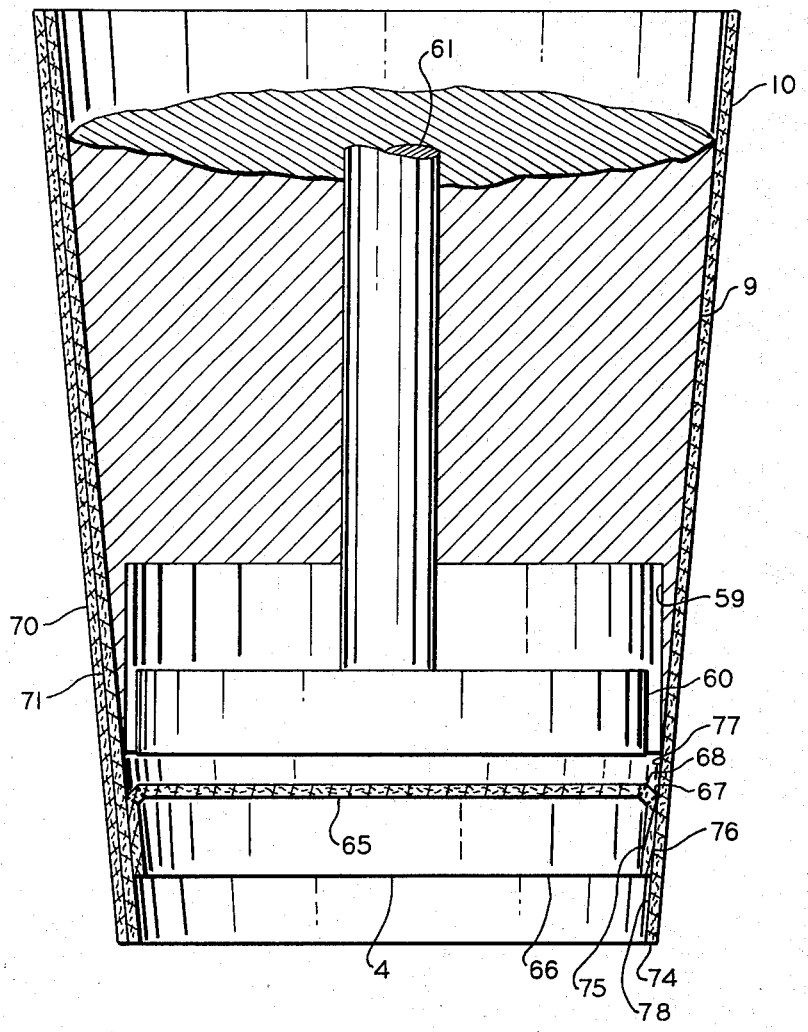
FIG. 4 is an enlarged fragmentary sectional view of a portion of the container-forming apparatus showing container portions.
Figure 7:
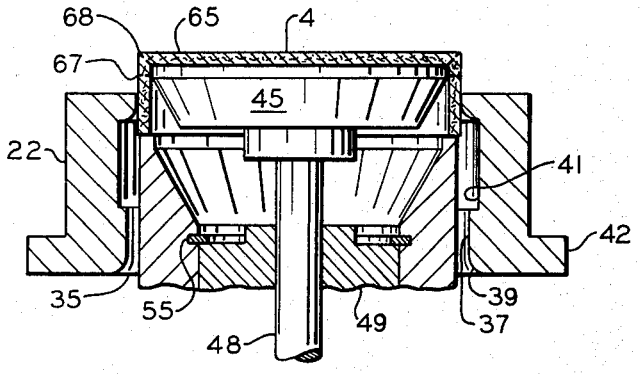
FIG. 7 is a view similar to FIG. 5 showing the bottom member in a third stage of formation.
Figure 8:
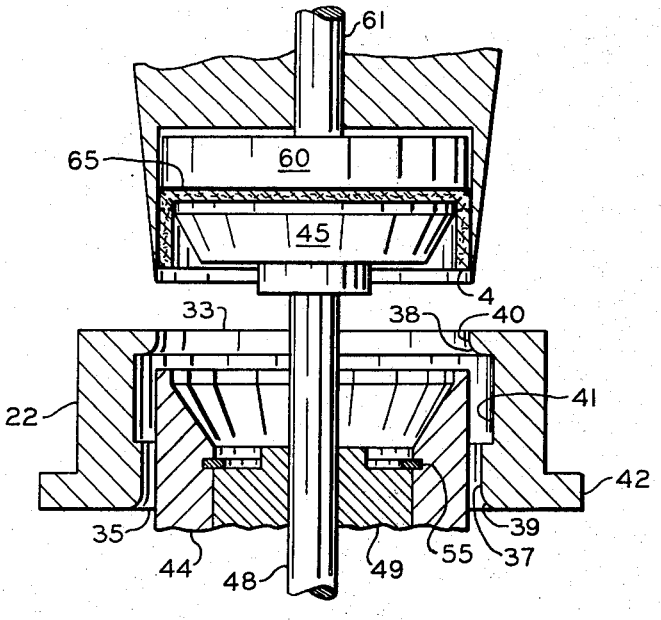
FIG. 8 is a view similar to FIG. 5 showing a formed bottom member positioned in a mandrel after forming.

As best seen in FIGS. 5 and 7, after movement of the plunger 44 is terminated, pressurized air is supplied to the cylinder-forming bore 46 to effect extension of the plunger 45 through the forming area 38. Because the forming area 38 has a smaller diameter than the forming area 37, a second fold or score line 68 is formed on the bottom member 4 and is positioned inside of the score line 67 and preferably is concentric therewith. Further movement of the plunger 45 moves the bottom member 4 into the pocket 59 whereby the diameter of the score line 68 is substantially equal to or just slightly less than the diameter of the pocket 59. Preferably the plunger 44 is spaced from the surface defining the forming area 37 and the plunger 45 is spaced from the surface defining the forming area 38 a distance substantially equal to or slightly larger than the thickness of the bottom blank 21. It is to be noted that the smaller fold line 68 allows easy insertion of the bottom member 4 into the pocket 59 and the larger fold line 67 allows intimate contact of the skirt 66 with the sidewall 10 described below. After inserting the bottom member 4 into the pocket 59, the plunger 44 and 45 are retracted from the die 22 and pocket 59. Referring to FIG. 1, with the bottom member 4 in position in the pocket 59, the mandrel 9 is moved to a position adjacent the sidewall heater 7 and sidewall feeder 6 whereby a sidewall blank 12 is suitably moved into engagement with the mandrel 9 and held there by the clamp 8. After this operation, the mandrel 9 is then indexed to the sidewall wrapper 11 which is operable to convolute or wrap the sidewall around the mandrel 9 forming an overlap or seam 70. The overlapping portions of the sidewall blank 12 are secured together in any suitable manner such as by adhesion of the sidewall coating such as polyethylene to join same as at 71 and thereby form the sidewall 10. As best seen in FIG. 4, a portion of the sidewall 10 extends past the end of the mandrel 9 and when the mandrel 9 is indexed to the bottom heater 13, the ejector 60 is actuated to move the bottom member 4 out of the pocket 59 whereby the skirt 66 flares outwardly with the score line 68 having a diameter substantially equal to or slightly larger than the diameter of the container 2 at the point at which movement of the bottom member 4 is terminated. It is seen that the diameter of the ejector 60 is small enough so as not to engage the sidewall 10 during ejection of the bottom member 4. The bottom member 4, particularly the skirt 66 and the lower portion of the sidewall 10 are heated by the bottom heater 13 and are then moved to the bottom former 14 whereby same are secured together as by adhesion of the coating therebetween. The bottom former 14 also reverse bends a lower portion 74 of the sidewall 10 to partially overlie an interior surface 75 of the skirt 66. As best seen in FIG. 9, the bottom member 4 has the exterior surface 76 of the skirt 66 secured to the interior surface 77 of the sidewall 10 and the interior surface 75 of the skirt 66 is also secured to a surface portion 78 of the interior surface 77. The finished container is then indexed to a position for ejection into the container receiving member 17 of the turret 16 after which a bead 19 is formed on the open end of the container 2 by the top bead former 18, as is known in the art.

The present apparatus is particularly well adapted for the manufacture of polymeric-coated paperboard containers which have a tapered sidewall with the bottom or closed end having a smaller diameter than the open upper end. However, it is to be noted that the present invention can also be used to manufacture containers having cross-sections other than circular and oppositely tapered or untapered containers of any suitable material.

It is to be understood that while we have illustrated and described certain forms of our invention, it is not to be limited to the specific form or arrangement of parts herein described and shown.

What is claimed and desired to be secured by letters patent is:

1. An apparatus for forming a container having a sidewall and a bottom member, said apparatus including:

a. a forming die having a plurality of different sized forming areas;

b. feed means cooperating with said forming die and is operable for feeding blanks to said forming die;

c. a plunger arrangement positioned adjacent said die and adapted to move a blank from said feed means into said die, said plunger arrangement having a plurality of different sized portions for cooperating with a respective forming area to form a plurality of spaced apart fold lines on said blank; and d. means connected to said plunger arrangement and operable to selectively move same into said die and retract same from said die.

2. The apparatus as set forth in claim 1 including:

a. a mandrel with a pocket opening generally toward said plunger arrangement and die and adapted to receive a bottom member therein; and b. ejector means in said pocket and operable for selectively ejecting a bottom member therefrom.

3. The apparatus as set forth in claim 2 wherein:

a. said die having first and second opposite open ends with said plurality of different sized forming areas therebetween with a larger sized first forming area being adjacent said first open end and a smaller sized second forming area being adjacent said second open end; and b. said plunger arrangement having first and second portions with said second portion being movable independently of said first portion, said first portion being sized and shaped to be received in said first forming area and said second portion being sized and shaped to be received through said second forming area.

4. The apparatus as set forth in claim 3 wherein:

a. said second portion is movable through said die and operable to insert a bottom member into said pocket.

5. The apparatus as set forth in claim 3 wherein:

a. said first portion having a cylinder forming bore therein; and b. said second portion having a piston forming portion sized and shaped to be received in said bore to cooperate therewith and form an extendable ram arrangement to effect movement of said second portion independently of said first portion.

6. The apparatus as set forth in claim 3 wherein:

a. said first and second forming areas and said first and second portions are substantially round.

7. An apparatus for forming a container having a sidewall and a bottom member, said apparatus including:

a. a die having a through bore with first and second open ends with first and second forming areas of different sizes and positioned between said first and second ends;

b. feed means adjacent said die cooperating therewith and is operable to feed blanks to said die;

c. a plunger arrangement positioned adjacent said die and operable to move a blank through said die from said first end to said second end, said plunger arrangement having first and second portions of different size with said second portion being smaller than said first portion and is independently movable relative thereto, said first portion is sized and shaped to be received in said first forming area and said second portion is sized and shaped to be received through said second forming area; and d. power operated means with said plunger arrangement mounted thereon and operable to selectively move said plunger arrangement into said die and retract same from said die.

8. The apparatus as set forth in claim 7 including:

a. a clearance recess positioned between said first and second forming areas.

* * * * *